US005848740A

United States Patent [19]

Burghaus

[11] Patent Number: 5,848,740

[45] Date of Patent: Dec. 15, 1998

[54] CONTAINER FOR DISPENSING A PRESSURIZED FLUID INCLUDING A SAFETY DEVICE FOR RELEASE OF EXCESSIVE INTERNAL PRESSURE

[75] Inventor: Johannes Burghaus, Ober-Ramstadt, Germany

[73] Assignee: Wella AG, Darmstadt, Germany

[21] Appl. No.: 904,372

[22] Filed: Aug. 1, 1997

[30] Foreign Application Priority Data

Aug. 14, 1996 [DE] Germany ..... 196 32 777.6

[51] Int. Cl.[6] ..... B05D 83/00

[52] U.S. Cl. ..... 222/397; 222/396

[58] Field of Search ..... 222/396, 397

[56] References Cited

U.S. PATENT DOCUMENTS

| | | | |
|---|---|---|---|
| 2,757,964 | 8/1956 | Both et al. | 222/397 |
| 3,074,602 | 1/1963 | Shillady et al. . | |
| 3,918,610 | 11/1975 | Willis . | |
| 4,175,678 | 11/1979 | Fukuda | 222/396 |
| 4,610,370 | 9/1986 | Patterson et al. | 222/397 |
| 5,042,675 | 8/1991 | Patterson | 222/397 |
| 5,183,189 | 2/1993 | Baudin | 222/397 |
| 5,197,622 | 3/1993 | Anderson | 222/397 |

*Primary Examiner*—Andres Kashnikow
*Assistant Examiner*—Keats Quinalty
*Attorney, Agent, or Firm*—Michael J. Striker

[57] ABSTRACT

The container for dispensing pressurized fluids includes a container-closing valve plate and a dispensing valve mounted in the valve plate. The dispensing valve includes a sealing disk (13); a closing body (15) and a membrane (14) in one piece with the closing body under the sealing disk (13), an inwardly-directed circumferential fold of the valve plate compressing and holding peripheral edges of the sealing disk and membrane together and the closing body (15) having at least one throughgoing passage; and a foam head (16) with an extension (17) engaged in a blind hole provided in the closing body (15) so that, when the foam head (16) is depressed, the at least one throughgoing passage in the closing body (15) is unsealed so that the pressurized fluid can flow through it. A safety valve device is provided for releasing a container over-pressure including at least one ring-like indentation provided in the valve plate by reducing a valve plate thickness and dimensioned so that rupture occurs when a predetermined over-pressure occurs in an interior portion of the container.

6 Claims, 2 Drawing Sheets

CONTAINER FOR DISPENSING A PRESSURIZED FLUID INCLUDING A SAFETY DEVICE FOR RELEASE OF EXCESSIVE INTERNAL PRESSURE

BACKGROUND OF THE INVENTION

The invention relates to a container for a pressurized fluid or liquid which has a mouth which is closed by a valve plate having a valve and the valve plate has at least one indentation reducing the thickness of the valve plate as a safety valve. An impermissible pressure increase, especially due to decomposition of hydrogen peroxide or an impermissibly high temperature, can occur in the container for the pressurized fluid, especially in aerosol cans.

Different safety valves are known for controlling relief of the excess pressure. For example, a point or circular shaped indentation is described in U.S. Pat. No. 3,074,602, which is torn away when the valve plate is deformed by excess pressure. Furthermore an aerosol can having a valve plate provided with a circumferential corrugation or seam pressed into its outer edge region, which is interrupted by six radially extending cross members, is disclosed in U.S. Pat. No. 3,918,610. As a safety valve two of the cross members are each provided with at least one indentation, which extends transversely over the cross member, continuing in the sides walls of the cross member and through a short piece of base of the seam adjacent the cross member. Also a deformation of the valve plate is a prerequisite for the tearing out of the indentation in this safety valve.

In order to provide a release of the safety valve at a predetermined pressure and to prevent an undesirable release by mechanical impacts and the like during transport, in use or due to an undesirable heating of the contents of the aerosol can, an exact as possible release threshold must be provided during manufacture of the aerosol can. This however is not possible with the known aerosol cans in which a deformation of the valve plate is required for release of the safety valve.

SUMMARY OF THE INVENTION

It is an object of the present invention to provide a container for pressurized fluid with a safety valve which is simple and economical and which releases as accurately as possible at a predetermined pressure.

According to the invention, the container for a pressurized fluid, includes a valve plate holding a valve, which covers an opening of the container, and safety valve means for releasing an over-pressure produced in the container. This safety valve means includes at least one indentation provided in the valve plate which reduces a valve plate thickness, which is ring-like and which encloses a surface of the valve plate dimensioned so that rupture and thus release of excess pressure occurs at the at least one indentation when a predetermined over-pressure occurs in an interior portion of the container.

In a preferred embodiment of the invention the at least one indentation and the surface enclosed by it are arranged in the valve plate beside the valve. However a considerably larger effective surface can be provided in embodiments in which the axis of the valve passes through the surface enclosed by the at least one indentation.

The thickness of the valve plate in the at least one indentation is selected for pressures generally allowed for aerosol cans so that the required tolerances for the thickness in the sense of as repeatable and as accurate as possible a rupture pressure can be obtained using conventional punch tools. Furthermore the container according to the invention has the advantage that no additional parts are required. Thus materials are saved and costs eliminated.

The invention does not require that the ring-shaped indentation be in the form of a circle. The indentation can be provided both on the inside and also on the outside of the valve plate.

If the indentation forms a closed ring, the inner portion of the valve plate with the valve is ejected on activation of the safety valve means. Since this is undesirable in many cases, in another embodiment of the invention it is provided that the at least one indentation is shaped like a circular arc and that there is an arc shaped unindented region between the arc ends. It has proven advantageous when the arc shaped unindented region of the valve plate extends over a circumferential angle of between 10°and 90°.

A container for pressurized fluid is disclosed in German Patent Application DE 29 16 699 C2, in which the valve plate includes means for receiving a sealing disk in an inner region thereof. This means for receiving the sealing disk comprises an inwardly directed fold in the valve plate pointing toward the valve axis and a disk-like portion of the valve plate extending from or standing on the fold. The at least one indentation is provided in the disk-like portion. For this kind of container it has proven advantageous when the at least one indentation is arranged in the disk-like portion. In this embodiment it is guaranteed that the at least one indentation can be made at a time during the manufacturing process of the valve plate during which the valve plate can be fed to a punch machine without special measures and the indentation cannot be ruptured by subsequent processing steps, e.g. deep drawing.

In this embodiment it is especially satisfactory in the sense of as small a release or rupture pressure as possible with sufficient residual thickness of the at least one indentation when the at least one indentation is arranged in an edge region of the disk-like part. Moreover in this embodiment the sealing disk can easily pass through the opening formed by activation of the release means.

Since the sealing disk is made from an elastic material, the diameter of the ring-like indentation can be varied, for example in relation to the rupture pressure and can however, if necessary, be smaller than the diameter of the sealing disk. However the diameter of the ring-like indentation should correspond substantially to the diameter of the sealing disk.

Other advantageous embodiments of the invention are possible in which the disk-like portion has a circumferential shoulder and the at least one indentation is provided outside of the circumferential shoulder.

BRIEF DESCRIPTION OF THE DRAWING

The objects, features and advantages of the invention will now be illustrated in more detail with the aid of the following description of preferred embodiments, with reference to the accompanying figures in which.

DESCRIPTION OF THE PREFERRED EMBODIMENTS

Figure 1:
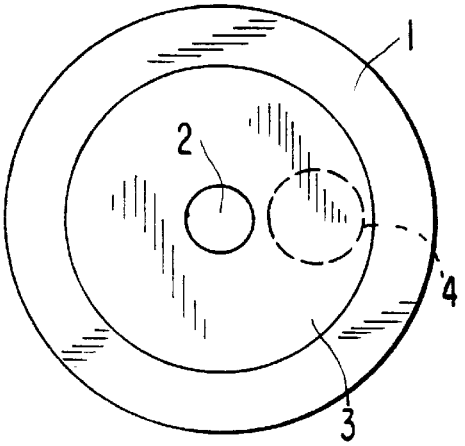
FIG. 1 is a simplified top view of a first embodiment of the invention.

FIG. 1 shows a valve plate of an aerosol can with an attachment collar 1, which encloses a flanged mouth 8 of the aerosol can which is otherwise not shown, and a dispensing nozzle 2. A circular indentation 4 provides a break-off or rupture element in the circular surface 3 enclosed by the attachment collar 1 and the dispensing nozzle 2. The indentation can be provided on the inside as shown in FIG. 1, or on the outside.

Figure 2A:
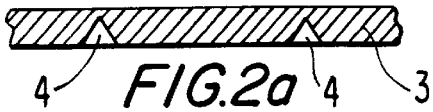
FIG. 2*a* is a detailed cutaway diagrammatic cross-sectional view through the plate of the first embodiment prior to a release of excess pressure.
Figure 2B:
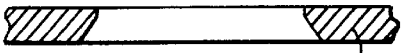
FIG. 2*b* is a detailed cutaway diagrammatic cross-sectional view through the plate of the first embodiment after a release of excess pressure.
Figure 3:
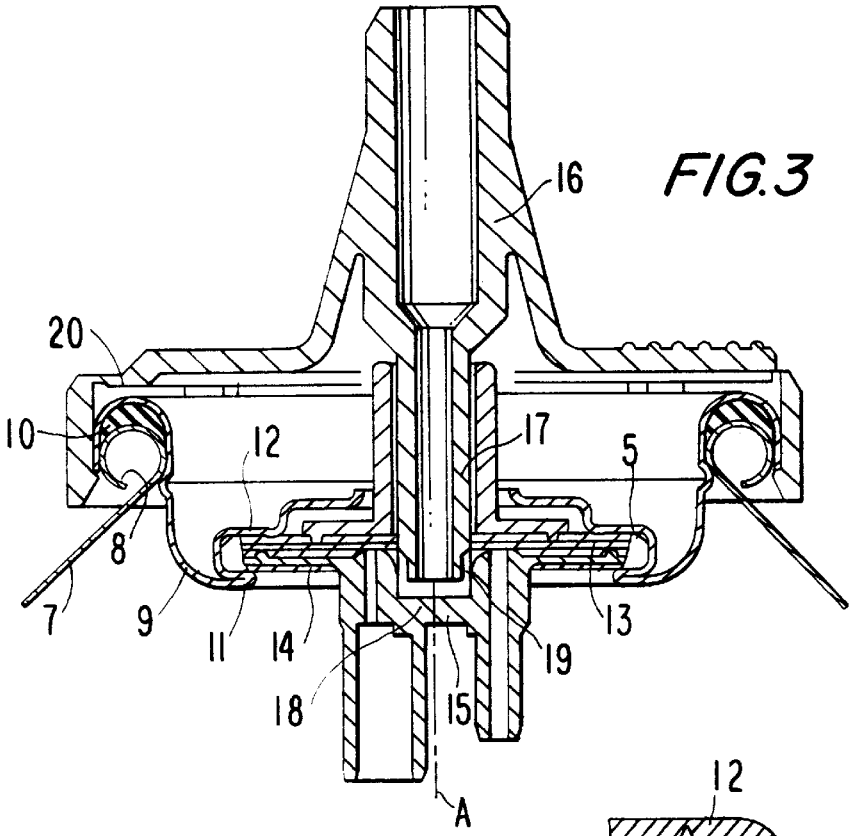
FIG. 3 is a cross-sectional view through a second embodiment according to the invention.
Figure 4:
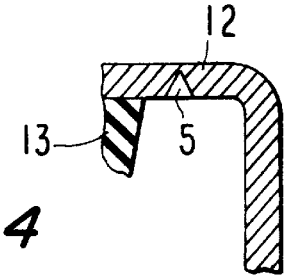
FIG. 4 is a detailed cutaway partial cross-sectional view of the device shown in FIG. 3.
Figure 5:
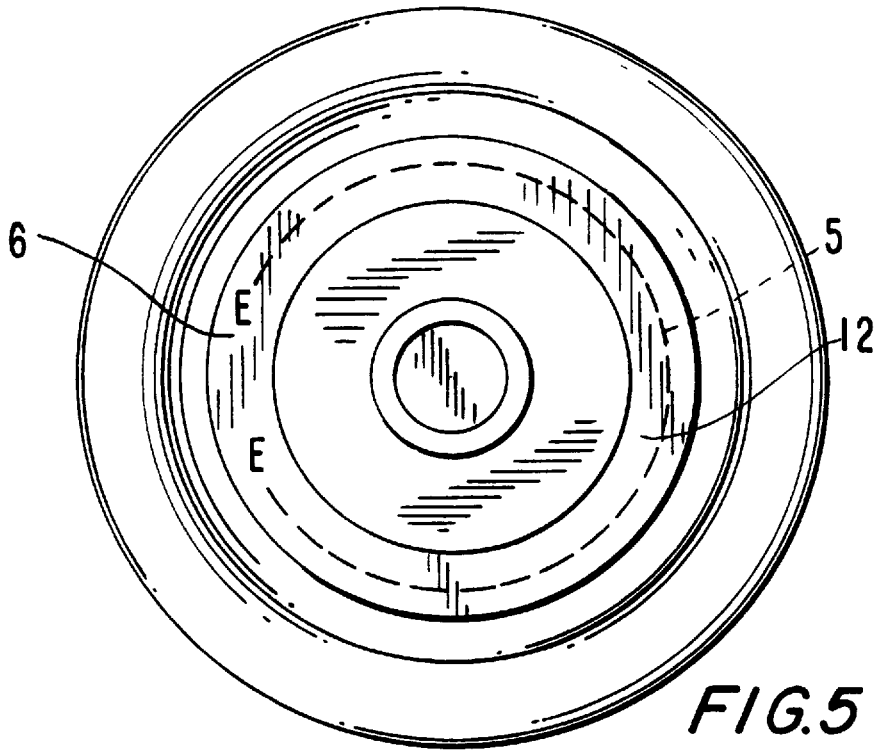
FIG. 5 is a top view of a part of the embodiment according to FIG. 4 with foam head removed.

FIG. 2*a* shows a cross-section through a part of the surface 3 of a valve plate in a closed condition, while FIG. 2*b* shows the safety valve ruptured as a result of an over-pressure and thus in an open condition.

Figure 6:
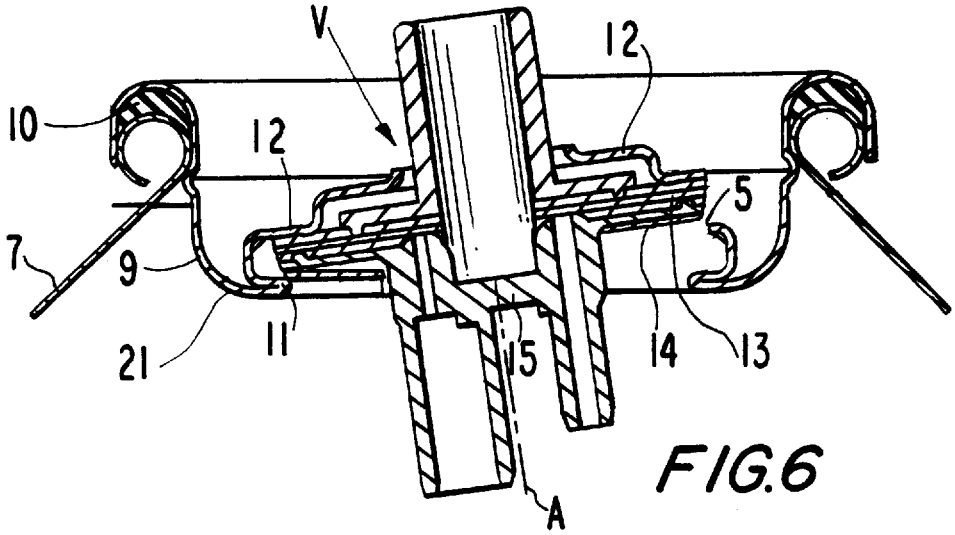
FIG. 6 is cross sectional view of the embodiment of FIG. 4 after a release of excess pressure.

In the embodiment shown in FIGS. 3 to 6 a concentric arc-shaped indentation 5 running around the valve axis A is provided as a break-off element. An arc-shaped unindented portion 6 extends over a circumferential angle of about 60° between the arc ends E of the arc-shaped indentation 5, so that the part found inside the arc-shaped indentation 5 is not completely released from the valve plate during rupture, but only tilted (FIG. 6). The remaining parts of the embodiment shown in FIGS. 3 to 6 are described, for example, from German Patent Application 29 16 699 C2, which is incorporated here by reference. An illustration of these parts is given in the following only in so far as it is required for an understanding of the invention. The aerosol can 7 only indicated has a flanged mouth 8 which is closed at its edge with a valve plate 9, which has a peripheral seal 10.

The valve plate 9 is formed so that the edges of a valve seal or sealing disk 13 and a membrane 14 are compressed between an interiorly directed circumferential fold 11 and a disk-shaped portion 12. The membrane 14 is connected in one piece with a closing body 15 which contains throughgoing passages for two fluids found in the aerosol can and in an unshown elastic container in it. The valve V is opened by pressure on foam head 16, whereby an extension 17 of the foam head is forced into a blind hole 18 provided in the closing body 15 which is pushed downward so that the throughgoing passages are unsealed and liquid can flow via the groove 19 at the lower end of the extension 17 into the foam head 16.

As shown in FIG. 6, the break-off element 5 tears off or ruptures under excess pressure or over-pressure so that the interior part of the valve plate with the valve V tilts upward. Because of suitable tolerances the foam head not shown in FIG. 6 does not prevent this tilting.

For this case the membrane 14 is connected with the ring-shaped holder as described in the above-mentioned patent, this ring-shaped holder can be beveled at its outer edge so that it slides out together with the seal 13 from the valve plate in the case of a release or activation of the safety valve.

The disclosure in German Patent Application 196 32 777.6 of Aug. 14, 1997 is incorporated here by reference. This German Patent Application, at least in part, describes the invention described hereinabove and claimed in the claims appended hereininbelow and provides the basis for a claim of priority for the instant invention under 35 U.S.C. 119.

While the invention has been illustrated and described as embodied in a container for a pressurized fluid, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A container for dispensing pressurized fluids, said container comprising:

a valve plate (9) including a disk-like portion (12) and an inwardly-directed circumferential fold extending around the disk-like portion (12) and means for dispensing a pressurized fluid contained within the container, wherein said means for dispensing is a dispensing valve held in said valve plate (9) and including a sealing disk (13);

a closing body (15) and a membrane (14) in one piece with the closing body under the sealing disk (13), said inwardly-directed circumferential fold compressing and holding peripheral edges of the sealing disk and membrane together and said closing body (15) being provided with at least one throughgoing passage for said pressurized fluid; and a head (16) with an extension (17) engaged in a blind hole provided in the closing body (15) so that, when said head (16) is depressed, the at least one throughgoing passage in the closing body (15) is unsealed so that the pressurized fluid is dispensed from the container; and safety valve means for releasing an over-pressure in said container, said safety valve means including at least one ring-like indentation (5) provided in said valve plate (9) by reducing a valve plate thickness of the valve plate (9), said at least one ring-like indentation (9) enclosing a surface of the valve plate and being dimensioned so that rupture occurs at said at least one ring-like indentation (5) when a predetermined over-pressure occurs in an interior portion of the container.

2. The container as defined in claim 1, wherein said dispensing valve has a valve axis (A) and said valve axis (A) passes through said surface enclosed by said at least one ring-like indentation (5).

3. The container as defined in claim 1, wherein said at least one ring-like indentation (5) is not completely circular, said at least one ring-like indentation is an arc-shaped indentation having arc ends and an arc-shaped unindented region extends between said arc ends.

4. The container as defined in claim 3, wherein said arc-shaped unindented region extends over a circumferential angle of between 10° and 90°.

5. The container as defined in claim 1, wherein said at least one ring-like indentation has a diameter substantially equal to that of said sealing disk.

6. The container as defined in claim 1, wherein said disk-like portion has a circumferential shoulder and the at least one ring-like indentation is provided outside of said circumferential shoulder.

* * * * *